US007255356B2

(12) United States Patent
Lin

(10) Patent No.: US 7,255,356 B2
(45) Date of Patent: Aug. 14, 2007

(54) GRINDING ASSISTANCE DEVICE FOR SKATEBOARDS

(75) Inventor: Chorng-Jiang Lin, Taichung (TW)

(73) Assignee: Great Lotus Corporation, Taichung (TW)

( * ) Notice: Subject to any disclaimer, the term of this patent is extended or adjusted under 35 U.S.C. 154(b) by 147 days.

(21) Appl. No.: 11/066,210

(22) Filed: Feb. 28, 2005

(65) Prior Publication Data

US 2006/0192357 A1 Aug. 31, 2006

(51) Int. Cl.
*B62M 1/00* (2006.01)

(52) U.S. Cl. ..... 280/87.041; 280/87.042

(58) Field of Classification Search ..... 280/87.01, 280/87.021, 87.041, 87.042, 842
See application file for complete search history.

(56) References Cited

U.S. PATENT DOCUMENTS 3,565,454 A * 2/1971 Stevenson et al. ..... 280/87.042
4,076,265 A * 2/1978 Eash, II ..... 280/87.042
4,515,379 A * 5/1985 Pasques ..... 280/11.27
4,773,239 A * 9/1988 Lowe et al. ..... 70/38 A
5,879,013 A * 3/1999 Shih ..... 280/11.28
6,019,382 A * 2/2000 Bouden ..... 280/87.042
6,213,484 B1 * 4/2001 Rohner ..... 280/87.042
6,318,739 B1 * 11/2001 Fehn, Jr. ..... 280/11.28
6,761,369 B1 * 7/2004 Anderson ..... 280/87.042
6,945,542 B2 * 9/2005 Stewart ..... 280/11.27
2002/0167142 A1 * 11/2002 Chen ..... 280/87.041

* cited by examiner

*Primary Examiner*—Frank Vanaman
(74) *Attorney, Agent, or Firm*—Rosenberg, Klein & Lee

(57) ABSTRACT

A skateboard includes a deck with two trucks connected to an underside of the deck and each truck has a case with two axles so that two rollers are rotatably connected to the two axles. Two protection members are connected to the two cases respectively and at least one cushion member is connected between respective one of the protection members and respective one of the cases. A rolling shaft is connected each of the two protection members and includes a mediate section which extends out from an opening of the protection member corresponding thereto so as to provide smooth grinding.

13 Claims, 8 Drawing Sheets

GRINDING ASSISTANCE DEVICE FOR SKATEBOARDS

FIELD OF THE INVENTION

The present invention relates to a skateboard having a protection member and a rolling shaft connected to each of the trucks.

BACKGROUND OF THE INVENTION

A conventional skateboard generally includes a deck with two trucks connected to an underside of the deck and each truck includes an axle with a roller on each end of the axle. The trucks each include a tubular case in which the axle is received and when the skateboard performs a grinding action on rails or other objects, the tubular case grinds on the rails or the other objects. The case has to be strong enough to bear the impact force and the grinding friction, or the case may be deformed and affect the alignment of the axle. If the axle directly grinds on the rail at one end, the axle could be deformed. If either the tubular case or the axle is deformed, the whole truck has to be replaced with a new one. In order to have smooth grinding, users wax the underside of the deck and the tubular case, however the wax is quickly removed.

The present invention intends to provide a grinding assistance device for a skateboard and includes a rolling shaft connected to each truck and the rolling shaft rolls on rails or objects when the skateboarders grind their skateboards.

SUMMARY OF THE INVENTION

The present invention relates to a skateboard that comprises a deck with two trucks connected to an underside of the deck and each truck has a case which has two axles, each axle being connected to a roller. A protection member is connected to each of the two cases and at least one cushion member is connected between each one of the protection members and a respective one of the cases.

Each of the cases may have a U-shaped handle connected thereto for convenience. A rolling shaft is rotatably connected to each of the cases for rolling on rails or objects on which the skateboard grinds.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
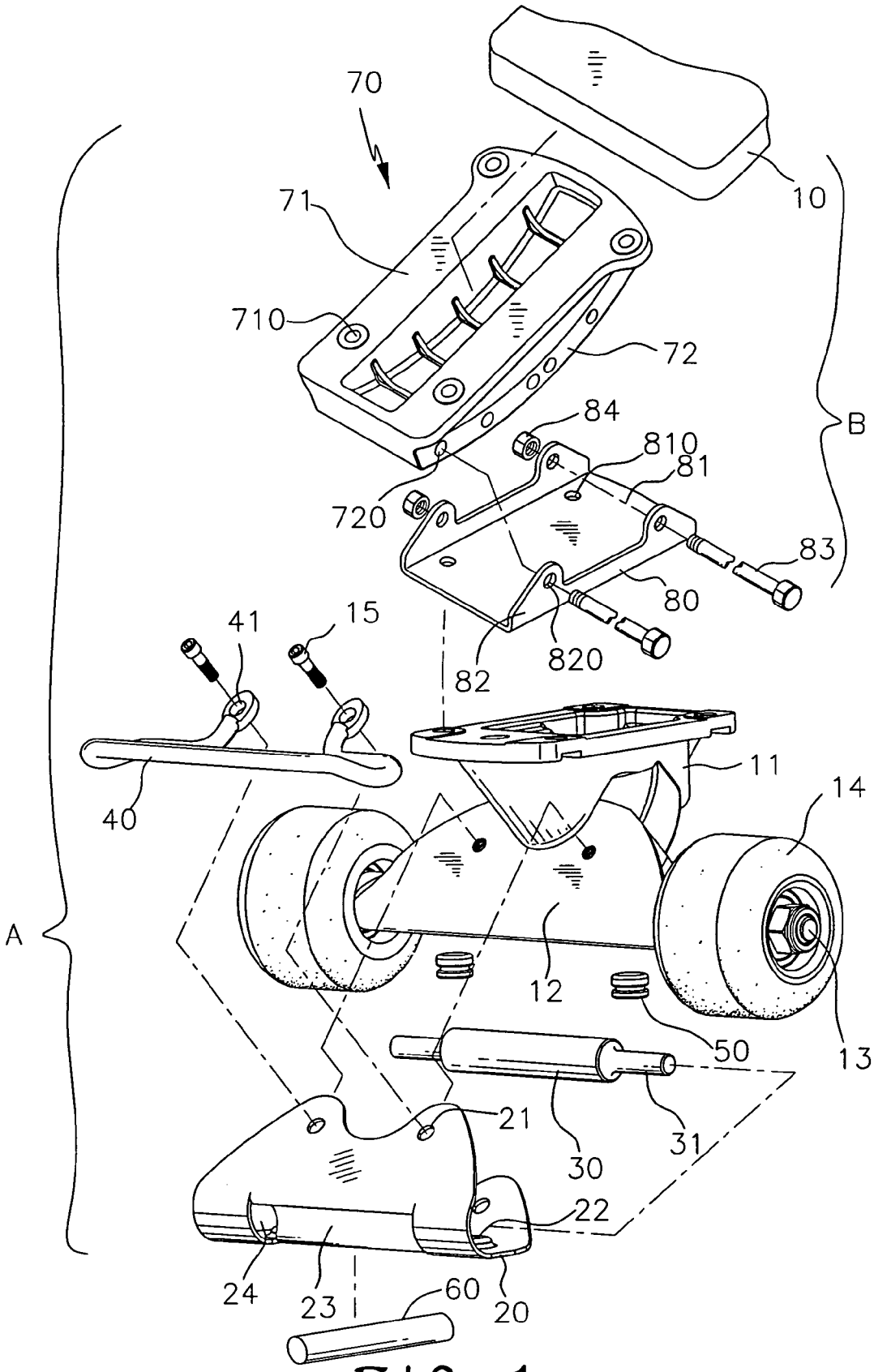
FIG. 1 is an exploded view to show the grinding assistance device and the adjustable device of the present invention.
Figure 2:
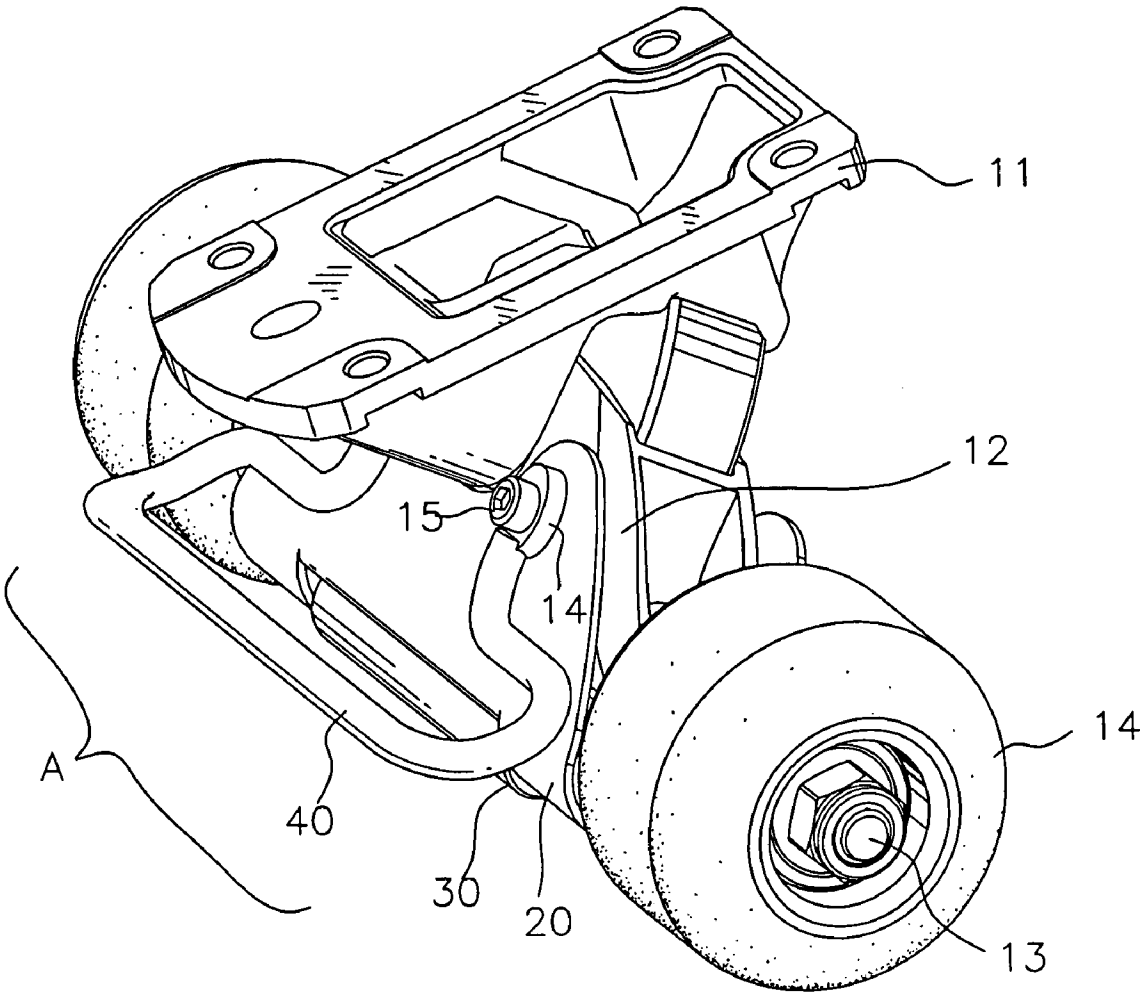
FIG. 2 is a perspective view to show the combination of the truck and the grinding assistance device of the present invention.
Figure 3:
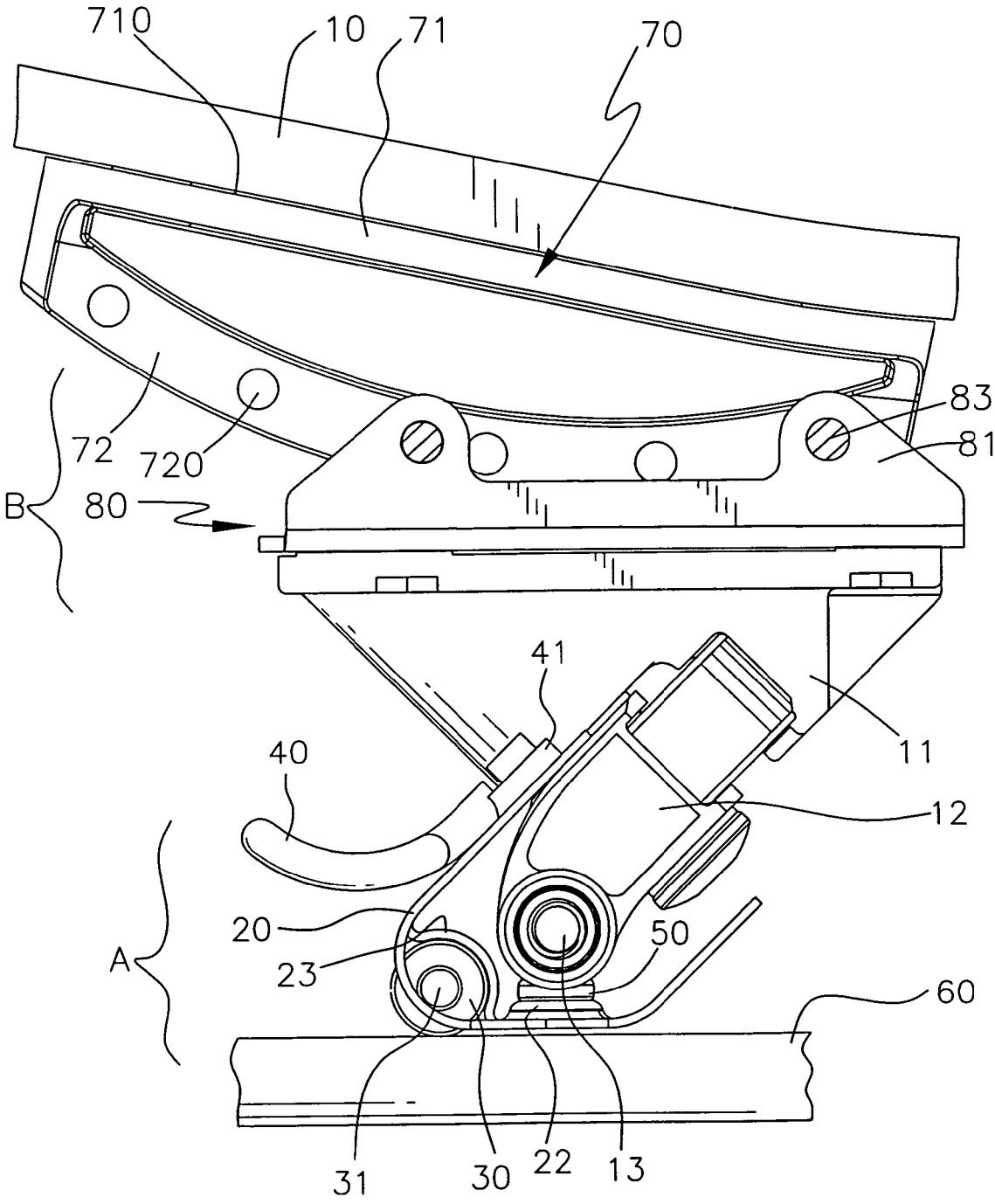
FIG. 3 is a side view to show a skateboard with the grinding assistance device and the adjustable device of the present invention.

Referring to FIGS. 1 to 3, the skateboard of the present invention comprises a deck 10 with two trucks 11 connected to an underside of the deck 10. Each truck 11 has a case 12 connected thereto. An axles 13 extends from each end of the case 12 and a roller 14 is rotatably connected to each axle 13. A grinding assistance device "A" is connected to each of the cases 12 and each grinding assistance device "A" may include different components such as a protection member 20, a handle 40 and a rolling shaft 30.

A protection member 20 is connected to each case 12. Each protection member 20 is U-shaped and is mounted to the case 12. Two support members 22 are located inside of each of the U-shaped protection members 20 and are respectively connected with an end of two cushion members 50 which are connected between the protection member 20 and the case 12 to provide cushioning. The cushion members 50 can be made of rubber or they can be springs.

Figure 6:
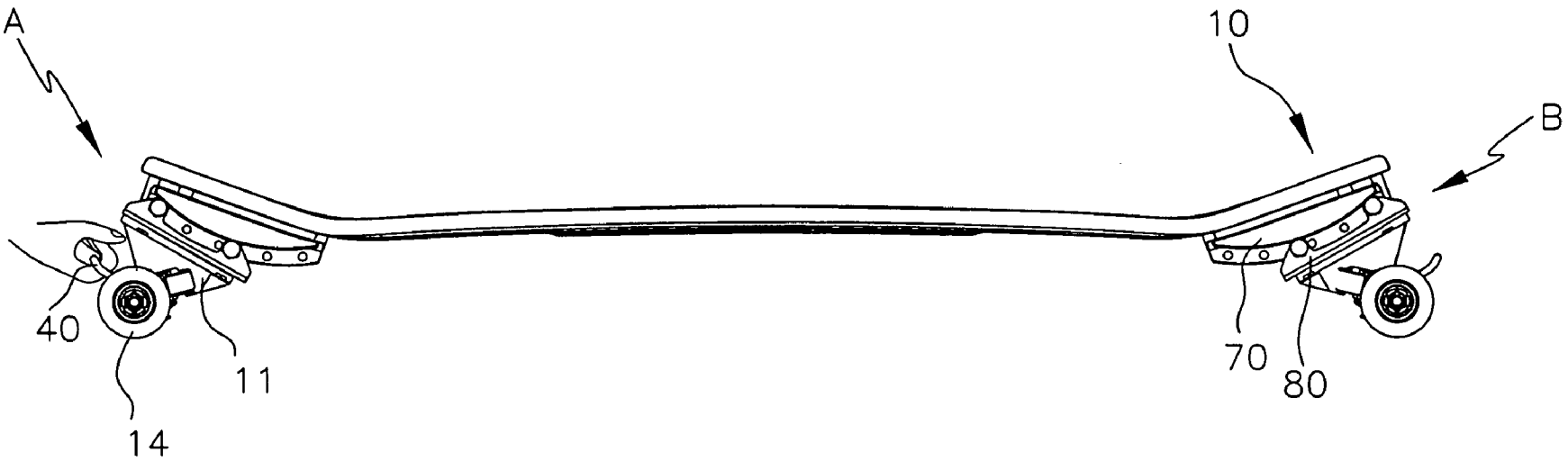
FIG. 6 shows that the adjustable members are located at a second position where the trucks are located away from each other.

Each protection members 20 has four connection holes 21 for connecting the protective member 20 to a respective case 12 by bolts 15. A U-shaped handle 40 is connected to each case 12, each handle 40 includes two extensions, each extension having a ring 41. The two bolts 15 extend through the rings 41 and are threaded to connect the handle 40 to the case 12. As shown in FIG. 6, the users can conveniently grasp the handle 40 to carry the skateboard.

Figure 4:
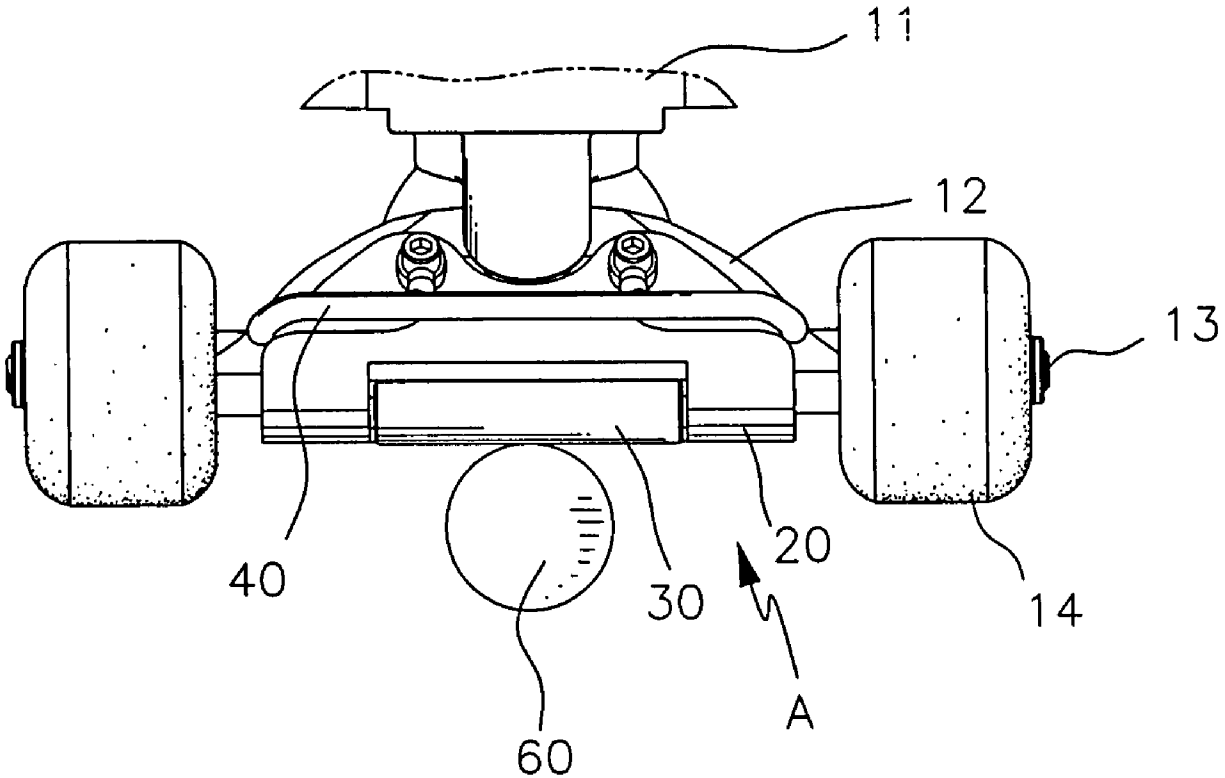
FIG. 4 shows the rolling shaft rolls on a rail.

Each of the protection members 20 includes an opening 23 with two frames 24. The opening 23 is located between the two frames 24. A rolling shaft 30 has two ends 31 which are rotatably connected to the two frames 24 and a mediate section of the rolling shaft 30 extends out from the opening 23. A diameter of the mediate section of the rolling shaft 30 is larger than that of each of the two ends 31 of the rolling shaft 30 so that the mediate section extends out from the opening 23. It is noted that the rolling shaft 30 is located in parallel to the axles 13 at a proper distance. As shown in FIG. 4, when grinding on a rail 60, the rolling shaft 30 rolls on the rail 60 without worry of possible damage to the case 12 and the axles 13.

Figure 7:
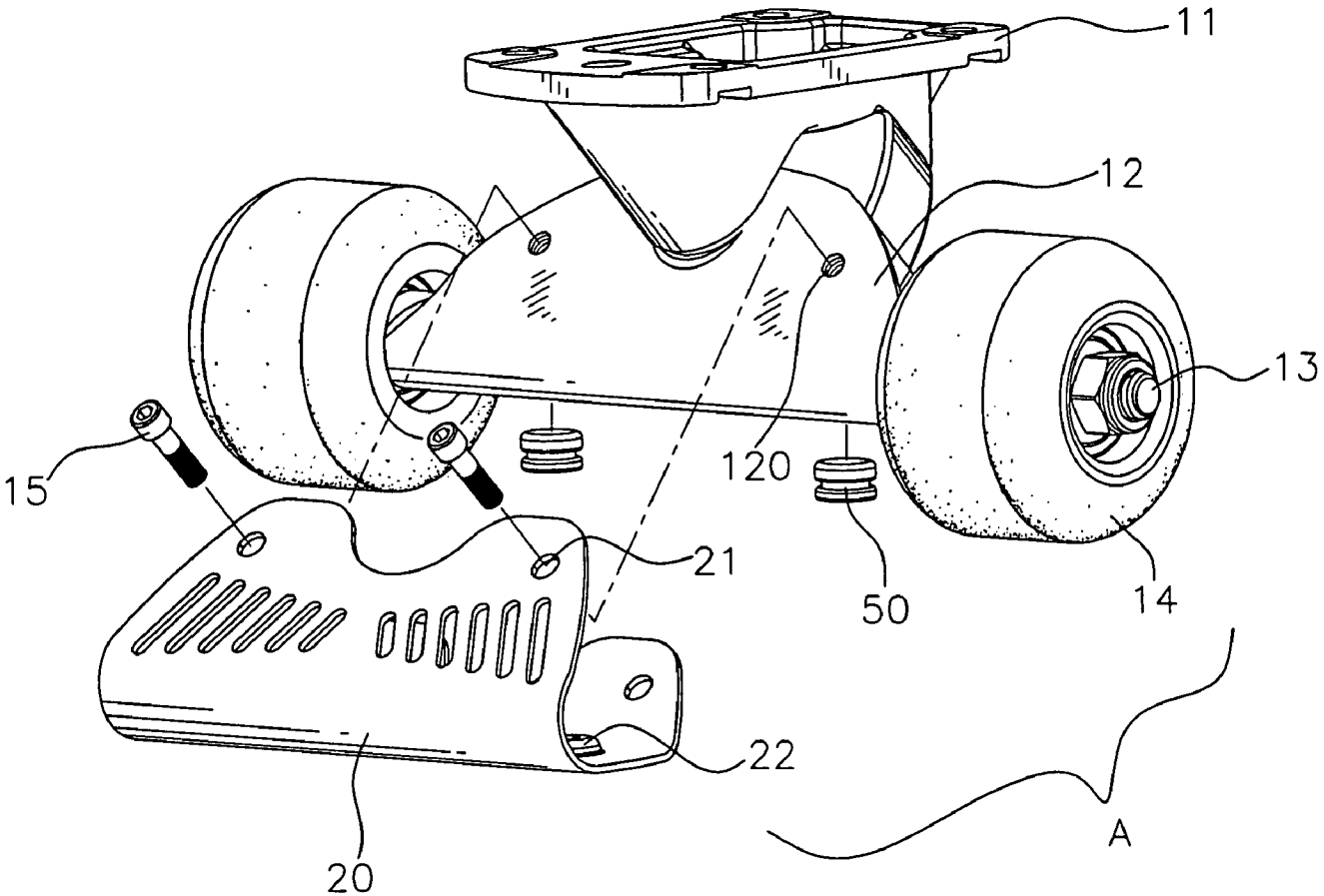
FIG. 7 shows that the grinding assistance device includes only the protection member and the cushion members.
Figure 8:
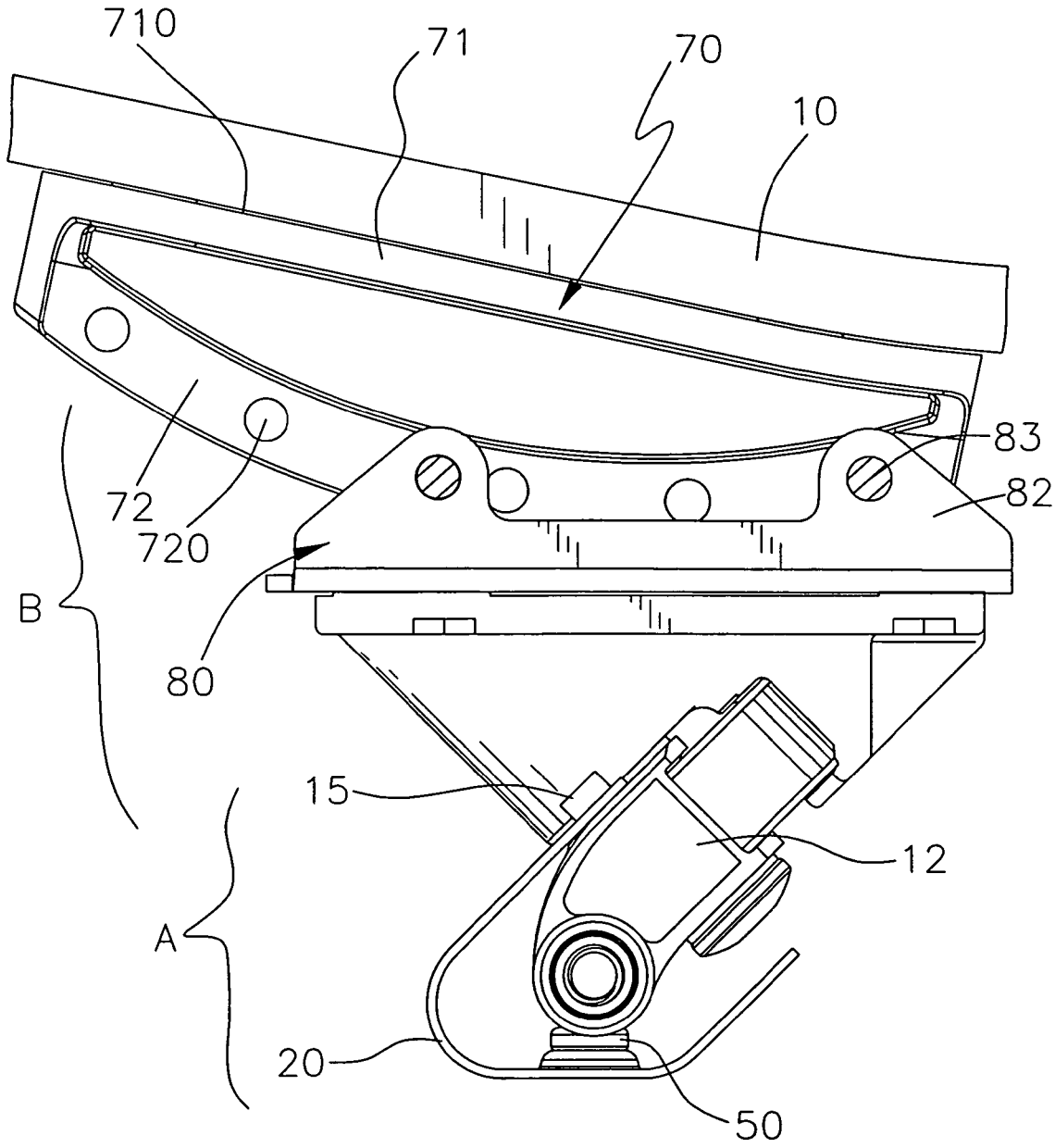
FIG. 8 shows a side view of the grinding assistance device in FIG. 7.

As shown in FIGS. 7 and 8, the grinding assistance device "A" may also be simplified to include only the protection member 20 on each of the cases 12 and the protection member 20 is made of durable material for grinding on rails or other objects.

Further referring to FIGS. 1, 3, 5 and 6, an adjustable device "B" is connected between each truck 11 and the underside of the deck 10. The adjustable device "B" includes a fix plate 80 which is fixed on the truck 11 corresponding thereto by extending bolts (not shown) through holes 810 defined through the fix plate 80 and connected to the top surface of the truck 11. The fix plate 80 includes two lugs 82 extending from each of two sides thereof and each lug 82 includes a hole 820. An adjustable member 70 is fixed to the underside of the deck 10 by its top surface 71 using bolts (not shown) extending through holes 710 in the adjustable member 70 and connected to the deck 10. The adjustable member 70 includes a protrusion 72 extending from an underside thereof and a plurality of connection passages 720 are defined through the protrusion 72. The protrusion 72 is connected between the two pairs of lugs 82 by extending bolts 83 through the holes 820 in the lugs 82 and the connection passages 720 and being connected to nuts 84.

Figure 5:
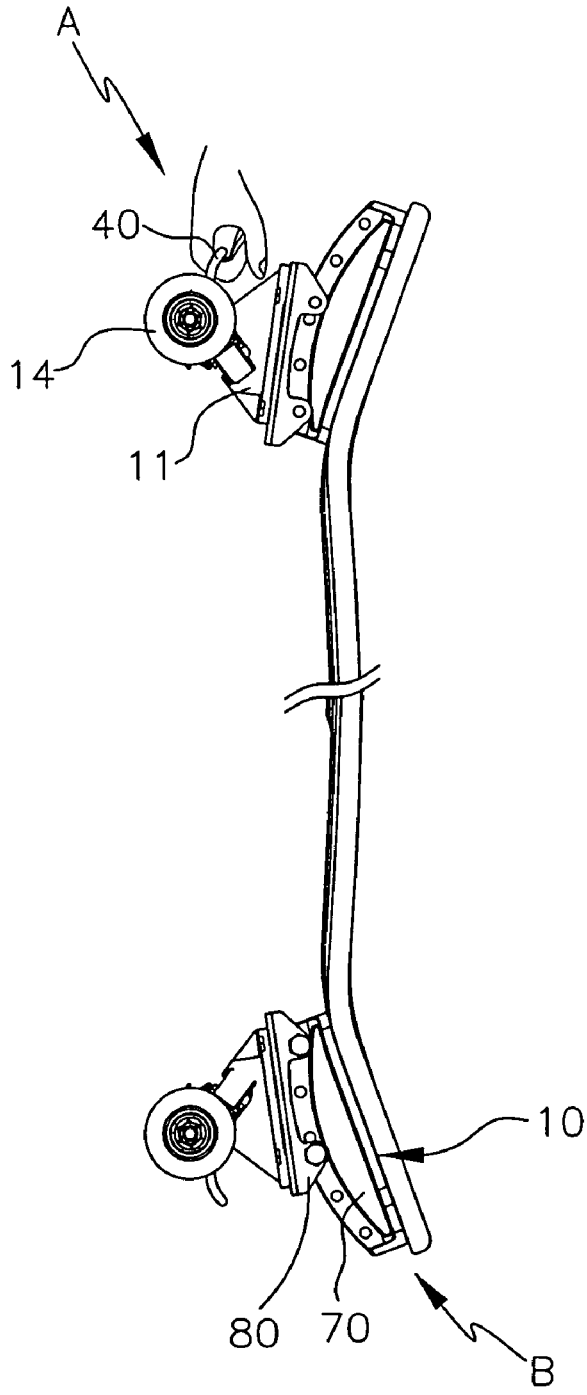
FIG. 5 shows that the adjustable members are located at a first position where the trucks are located close to each other.

The adjustable member 70 can be fixed to the fix plate 80 at a first position as shown in FIG. 5, where the trucks 11 are located close to each other. At this position, the skateboard is easily controlled for turning and is more suitable for performing different actions. FIG. 6 shows that the adjustable members 70 are located at a second position where the trucks 11 are located away from each other. At this position, the skateboard is stable and is more suitable for speed.

While we have shown and described the embodiment in accordance with the present invention, it should be clear to those skilled in the art that further embodiments may be made without departing from the scope of the present invention.

What is claimed is:

1. A skateboard comprising:

a deck with two trucks connected to an underside of the deck, each truck having a case connected thereto and an axle extending from each end of the case, a roller rotatably connected to each of the axles, a protection member connected to each case, wherein the protection member includes an opening with two frames, the opening being disposed between the two frames, a rolling shaft having two ends being rotatably connected to the two frames and a mediate section of the rolling shaft extending out from the opening, and at least one cushion member connected between each protection member and each respective case.

2. The skateboard as claimed in claim 1, wherein each of the cases has a handle connected thereto.

3. The skateboard as claimed in claim 2, wherein each handle includes two extensions and each extension has a ring, two bolts extend through the rings and are threaded to connect the handle to the case.

4. The skateboard as claimed in claim 1, wherein the protection member is a U-shaped member and mounted to the case, at least one support member located at an inside of the U-shaped protection member such that one end of the at least one cushion member is connected thereto.

5. The skateboard as claimed in claim 1, wherein a diameter of the mediate section of the rolling shaft is larger than that of each of the two ends of the rolling shaft.

6. The skateboard as claimed in claim 1, wherein an adjustable device is connected between each truck and the underside of the deck, the adjustable device includes a fix plate fixed on the truck corresponding thereto and an adjustable member which is adjustably connected to the fix plate and the underside of the deck in an elongated direction of the deck.

7. The skateboard as claimed in claim 6, wherein the fix plate includes two lugs extending from each of two sides thereof and the adjustable member includes a protrusion extending from an underside thereof, a plurality of connection passages defined through the protrusion which is connected between the two pairs of lugs by bolts.

8. A skateboard comprising: a deck with two trucks connected to an underside of the deck, each truck having a case connected thereto and an axle extending from each end of the case, a roller rotatably connected to each axle, and a rolling shaft connected to each of the cases parallel to the axles, wherein a diameter of a mediate section of the rolling shaft is larger than that of each of two ends thereof;

wherein a protection member is connected to each of the two cases respectively and at least one cushion member is connected between each protection member and a respective case; and, wherein each of the protection members includes an opening and two frames, the opening being disposed between the two frames, the rolling shaft having two ends rotatable connected to the two frames and the mediate section of the rolling shaft extending out from the opening.

9. The skateboard as claimed in claim 8, wherein each protection member is a U-shaped member and mounted to the case, at least one support member is located at an inside of the U-shaped protection member such that one end of the at least one cushion member is connected thereto.

10. The skateboard as claimed in claim 8, wherein each of the cases has a handle connected thereto.

11. The skateboard as claimed in claim 10, wherein each handle includes two extensions and each extension has a ring, two bolts extend through the rings and are threaded to connect the handle to the case.

12. The skateboard as claimed in claim 8, wherein an adjustable device is connected between each truck and the underside of the deck, the adjustable device includes a fix plate fixed on the truck corresponding thereto and an adjustable member which is adjustably connected to the fix plate and the underside of the deck in an elongated direction of the deck.

13. The skateboard as claimed in claim 12, wherein the fix plate includes two lugs extending from each of two sides thereof and the adjustable member includes a protrusion extending from an underside thereof, a plurality of connection passages are defined through the protrusion which is connected between the two pairs of lugs by bolts.

* * * * *